US005727674A

United States Patent [19]

St. John et al.

[11] Patent Number: 5,727,674

[45] Date of Patent: *Mar. 17, 1998

[54] STACKER-BUNDLER TRANSFER APPARATUS WITH POWERED ROLLER TABLE

[75] Inventors: John St. John, Lake Arrowhead; Jerry L. Bates, Redlands, both of Calif.; Clark L. Smith, Belle Mead, N.J.

[73] Assignee: Baldwin Technology Corporation, Rosemont, Ill.

[ * ] Notice: The term of this patent shall not extend beyond the expiration date of Pat. No. 5,540,422.

[21] Appl. No.: 636,601

[22] Filed: Apr. 23, 1996

Related U.S. Application Data

[63] Continuation-in-part of Ser. No. 326,129, Oct. 24, 1994, Pat. No. 5,540,422.

[51] Int. Cl.[6] ..... B65G 17/30

[52] U.S. Cl. ..... 198/809; 198/463.3; 198/586; 414/789.9

[58] Field of Search ..... 414/789.9, 790, 414/790.1; 270/52.14, 52.18, 58.07; 198/463.3, 586, 809

[56] References Cited

U.S. PATENT DOCUMENTS

| | | | |
|---|---|---|---|
| 1,756,920 | 4/1930 | Gollnick et al. . | |
| 2,124,678 | 7/1938 | Talbot | 414/790 |
| 2,156,248 | 4/1939 | Wegner | 198/463.3 |
| 2,329,413 | 9/1943 | Neja | 414/790.1 |
| 2,933,314 | 4/1960 | Stobb | 271/88 |
| 3,054,516 | 9/1962 | Joa | 414/790 |
| 3,164,270 | 1/1965 | Kinker | 214/6 |
| 3,501,139 | 3/1970 | Stobb | 271/68 |
| 3,635,463 | 1/1972 | Stobb | 271/6 |
| 3,739,924 | 6/1973 | Stobb | 214/6 |
| 3,743,078 | 7/1973 | Pittoreau | 198/121 |
| 3,811,549 | 5/1974 | Preisig | 198/21 |
| 3,825,134 | 7/1974 | Stobb | 214/152 |
| 3,982,749 | 9/1976 | Stobb | 271/4 |
| 4,005,792 | 2/1977 | Schulman et al. | 214/309 |
| 4,006,831 | 2/1977 | Jimenez | 414/790 |
| 4,049,259 | 9/1977 | Ventz | 271/151 |
| 4,172,531 | 10/1979 | Muller | 414/108 |
| 4,221,373 | 9/1980 | Muller | 270/86 |
| 4,313,600 | 2/1982 | Mosberger | 271/203 |
| 4,361,318 | 11/1982 | Stobb | 271/202 |
| 4,405,186 | 9/1983 | Sandberg et al. | 414/790 |
| 4,413,941 | 11/1983 | Kollman | 414/789.9 X |
| 4,463,940 | 8/1984 | Mock | 270/54 |
| 4,500,245 | 2/1985 | Madewell | 414/108 |
| 4,618,054 | 10/1986 | Muller | 198/409 |
| 4,723,883 | 2/1988 | Smith | 414/43 |
| 4,772,003 | 9/1988 | Nobuta et al. | 414/789.9 X |
| 4,984,677 | 1/1991 | Prakken | 198/418.6 |
| 5,022,813 | 6/1991 | Smith et al. | 414/790 |
| 5,133,543 | 7/1992 | Eitel et al. | 271/276 |
| 5,205,394 | 4/1993 | Zeuschner | 198/463.3 |
| 5,279,536 | 1/1994 | Abreu | 414/790 X |
| 5,282,716 | 2/1994 | Prim et al. | 414/790 |
| 5,393,196 | 2/1995 | Bluemle | 414/790.2 |
| 5,540,422 | 7/1996 | St. John et al. | 270/52.18 |

FOREIGN PATENT DOCUMENTS

| | | | |
|---|---|---|---|
| 2332808 | 1/1975 | Germany | 198/463.3 |
| 607979 | 12/1978 | Switzerland . | |
| 769133 | 2/1957 | United Kingdom . | |

*Primary Examiner*—Karen B. Merritt
*Assistant Examiner*—Douglas Hess
*Attorney, Agent, or Firm*—Roberts & Mercanti, LLP

[57] ABSTRACT

An improved bundle transfer apparatus for sheet material in signature form is provided. The apparatus includes a frame having rails on which a bundle transfer vehicle is mounted. The bundle transfer vehicle has a platform which is movable to a position under the signatures and a mechanism for raising the platform and the signatures. The signatures on the bundle transfer vehicle are transferred to an end of the table where it is moved by powered rollers to a compression and strapping station where it is tied and delivered for further handling.

18 Claims, 10 Drawing Sheets

STACKER-BUNDLER TRANSFER APPARATUS WITH POWERED ROLLER TABLE

CROSS REFERENCE TO RELATED APPLICATION

This application is a continuation in part of U.S. patent application Ser. No. 08/326,129, filed Oct. 24, 1994, now U.S. Pat. No. 5,540,422 which is incorporated herein by reference.

BACKGROUND OF THE INVENTION

1. Field of the Invention

The invention pertains to an apparatus for stacking, transferring and bundling sheet material in signature form as it is received from a conveying device. A delivery table comprising a series of on/off controlled, powered rollers thrusts a stack of sheet material from stack transferring apparatus to a compression and strapping station for further handling.

2. Description of the Prior Art

It is known in the graphic arts that sheet materials such as newspapers, books, printed cartons and the like emerge from a printing operation in a serial, partially overlapping shingled or signature form. In a conventional arrangement, a stream of sheets, for example in the form of newspapers, is collected on a conveyor which receives the sheets from the printing press, cutter or folder and which moves the sheets to a stacker. Stackers are commonly employed in the printing industry for collecting and aligning the signatures. The stacker receives the sheets in serial form from the conveyor and forms a neat aligned stack which is easy to bundle together for removal and transportation. Many stacking arrangements are known as exemplified by U.S. Pat. Nos. 2,933,314; 4,361,318; and 4,463,940 which are incorporated herein by reference. U.S. Pat. No. 4,463,940 describes a commonly used stacker having an upswept arcuate array of rollers sequentially engaging signatures with crusher rollers and opposed endless timing belts which are compression mounted by the series of rollers. U.S. Pat. No. 5,380,148 shows an improved stacker which is preferred for use by this invention and such is incorporated herein by reference. Folded, overlapped signatures exiting from the end of a printing press are stream conveyed along a horizontal course leading to the stacker. The stacker changes the stream path from horizontal to vertical. The signatures are initially crushed between rollers to compact them and to remove entrapped air. The stream of shingled signatures is thereafter passed between top and bottom conveyors which form a compression zone of the stacker and which maintains the signatures fully compressed during their transition from a horizontal stream to a vertical stream. Upon leaving the compression zone the stream of signatures has an upward thrust. They are then stopped, engage a receiver and form a growing, aligned rectangular stack of the signatures on a horizontal conveyor belt. The horizontally stacked product is then bundled, that is, compressed and strapped and then placed onto a skid, pallet or into a box for shipment. Bundling apparatus are also well known in the art. In this regard, see U.S. Pat. Nos. 3,982,749; 3,825,134; 3,739,924 and 3,635,463. Bundlers compress the stack of signatures to remove remaining compressed air and wrap a tight band of strapping material around the stacks for boxing or palletizing.

It has been a problem in the art to provide an efficient and effective means of transferring stacks of signatures from the horizontal exit conveyor of the stacker to the bundling station. While the stacking and bundling operations in and of themselves are routinely automated, the transfer from the stacker to the bundler has been a labor intensive task. In the past, a stacked pile of paper materials such as printed signatures has been assembled on flat tables after processing by the stacker conveyors. End boards, or pieces of plywood the same size as the signatures are placed at either end of the formed bundle and then the signatures and end boards are moved by hand to another portion of the table for compression and bundling. Such an operation has many disadvantages since such hand movement of the stacked signature requires considerable strength and effort and movement of the stack along the table tends to abrade and damage the lower edges of the signatures which are in contact with the table. Additionally, there is a disruption of signature alignment into an uncompressed group of signatures. One solution is embodied in the commercially available Baldwin Stobb DH series equipment. U.S. Pat. Nos. 4,723,883 and 5,022,813 which are incorporated herein by reference, have suggested other possible solutions which include a stacker to bundler shuttling apparatus. The equipment carries a collection of signatures from the stacker to a forward position on a table for subsequent compression and bundling. While this equipment considerably alleviates the effort required to move a stack from the stacker to a table, it has rather severe drawbacks. These systems are disadvantageous since a large force and a substantial manual effort are necessary to move the collection of signatures from the collection table to a compression and strapping station. The present invention improves on the forgoing disadvantages whereby a collection table is provided with a series of powered rollers which move the stack of signatures from the collection table to the compression and strapping station. These rollers are either manually or automatically controlled to turn when a stack of signatures has been deposited onto the table and not turn after and prior to stack placement on the roller table. As a result, much less manual labor is needed to move the stack to the compression and strapping station.

These and other features, advantages and improvements will be in part discussed and in part apparent to one skilled in the art upon a consideration of the detailed description of the preferred embodiment and the accompanying drawings.

SUMMARY OF THE INVENTION

Figure 1:
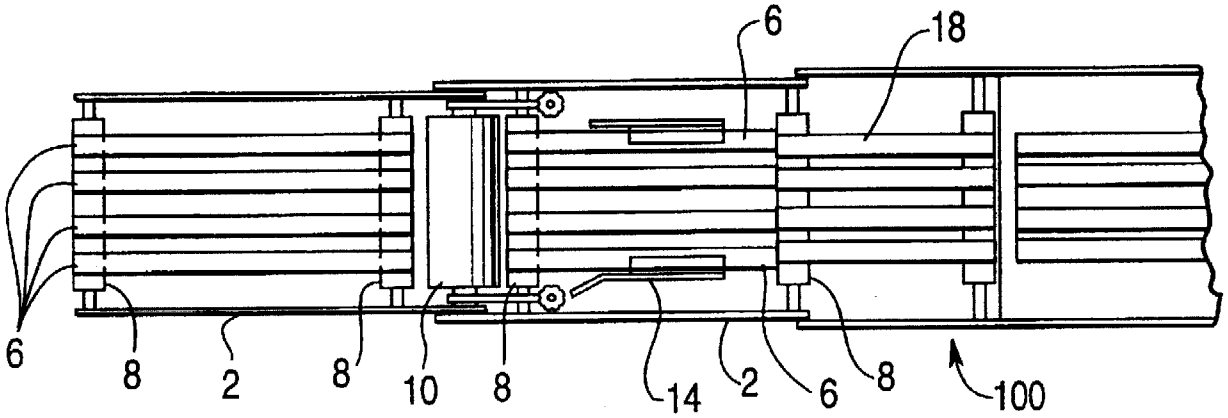
Fig. 1 PRIOR ART
FIG. 1 shows a top overview in schematic form of the layout of a prior art conveyor, crusher, jogger and stacker arrangement.

The invention provides an apparatus for transferring a bundle of sheet material in signature form comprising:

(a) a horizontal frame;

(b) a conveyor mounted longitudinally in the frame at an upper portion of a rearward section thereof and extending a part of the distance along the length of the frame, the conveyor comprising a plurality of horizontally disposed conveyor belts which are spaced apart to form gaps therebetween and which receive the sheet material in the form of a bundle of signatures on top of the belts;

(c) one or more rails mounted on the frame and extending about parallel to the conveyor belts from the rearward section of the frame to a forward section of the frame;

(d) a bundle transfer vehicle on the rails, said vehicle comprising a framework and friction reducing means mounted on the framework, which friction reducing means engages and rides on the rails; the framework having support segments thereon which are interdigitated and substantially aligned with the gaps between the conveyor belts, the support segments being capable of lifting and holding the sheet material away from the conveyor and depositing it onto a table; said table being located on the horizontal frame forward of the rails; said table comprising a plurality of parallel, horizontally disposed driven rollers which are spaced apart to form gaps therebetween and which is capable of receiving the sheet material on top of the table, said rollers being aligned with one of said conveyor belts and allow the passage of the support segments interdigitated in the gaps between the rollers.

The invention also provides an apparatus for transferring a bundle of sheet material in signature form comprising:

(a) a horizontal frame;

(b) a conveyor mounted longitudinally in the frame at an upper portion of a rearward section thereof and extending a part of the distance along the length of the frame, the conveyor comprising a plurality of horizontally disposed conveyor belts which are spaced apart to form gaps therebetween and which receive the sheet material in the form of a bundle of signatures on top of the belts;

(c) one or more rails on the frame and extending about parallel to the conveyor belts at least a part of the distance from the rearward section of the frame to a forward section of the frame, and means for raising and lowering the rails with respect to the conveyor;

(d) a bundle transfer vehicle on the rails, said vehicle comprising a framework and friction reducing means mounted on the framework, which friction reducing means engages and rides on the rails; the framework having support segments thereon which are interdigitated and substantially aligned with the gaps between the conveyor belts, the support segments being capable of lifting and holding the sheet material away from the conveyor and depositing it onto a table; said table being located on the horizontal frame forward of the rails; said table comprising a plurality of parallel, horizontally disposed driven rollers which are spaced apart to form gaps therebetween and which is capable of receiving the sheet material on top of the table, said rollers being aligned with one of said conveyor belts and allow the passage of the support segments interdigitated in the gaps between the rollers.

The invention further provides an apparatus for transferring a bundle of sheet material in signature form comprising:

(a) a horizontal frame;

(b) a first conveyor mounted longitudinally in the frame at an upper portion of a rearward section thereof and extending a part of the distance along the length of the frame, the conveyor comprising a first series of horizontally disposed conveyor belts which are spaced apart to form gaps therebetween and which receive the sheet material in the form of a bundle of signatures on top of the first series of conveyor belts; and (c) a second conveyor comprising a second series of conveyor belts mounted on the frame and extending about parallel to the first series of conveyor belts at least a part of the distance from the rearward section of the frame to a forward section of the frame; said second series of conveyor belts being interdigitated and substantially aligned with the gaps between the first series of conveyor belts, the second conveyor comprising means for alternately raising and lowering the second series of conveyor belts above and below the first series of conveyor belts; the second conveyor being capable of lifting and holding the sheet material away from the first conveyor and depositing the sheet material onto a table; said table being located on the horizontal frame forward of the second conveyor; said table comprising a plurality of parallel, horizontally disposed driven rollers which are spaced apart to form gaps therebetween and which is capable of receiving the sheet material on top of the table, said rollers being aligned with the second series of conveyor belts and allow the passage of the second series of conveyor belts interdigitated in the gaps between the rollers.

DETAILED DESCRIPTION OF THE PREFERRED EMBODIMENT

Figure 2:
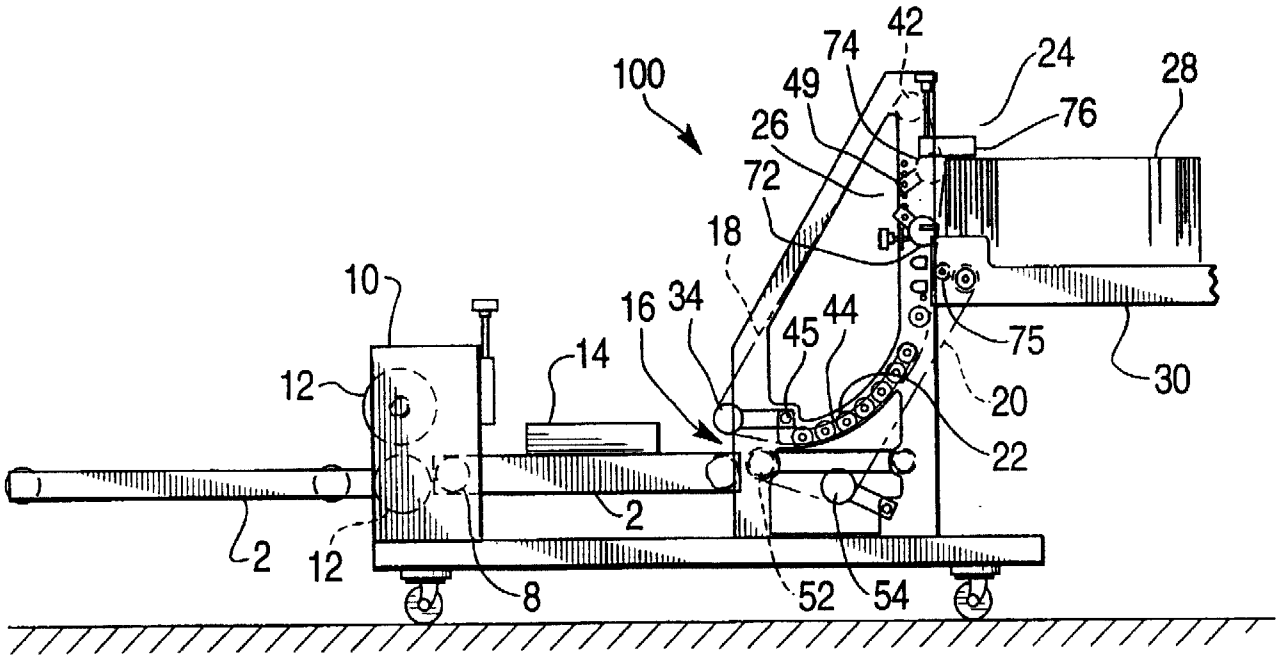
Fig. 2 PRIOR ART
FIG. 2 shows a side overview in schematic form of the layout of a prior art conveyor, crusher, jogger and stacker arrangement.

Referring to FIGS. 1 and 2, one respectively sees a top and side view of a stacker 100 together with attendant conveyors. A continuous stream of signatures flows along conveyor 2 from the end of a printing press, folding machine or cutting machine which are not shown. Single or multiple streams of signatures may be accommodated. Conveyor 2 is of conventional construction and includes supported conveyor belts 6 and rollers 8 as best seen in FIG. 1. Horizontal conveyor 2 is composed of several separate endless belts 6, spaced laterally apart. These belts move at the same speed and convey the signatures in a shingled stream partially overlapping form. Preferably disposed in-line with conveyor 2 is a crusher station 10. Crusher station 10 comprises two opposed crusher rollers 12. The upper roller is vertically adjustable relative to its lower counterpart roller. The crusher presses on the approaching shingled signatures to exhaust air and flatten them for their transition from horizontal to vertical travel. Optionally, the crushed signatures may then pass through a jogging station 14 to align the signatures edgewise and move them forward. In operation, folded, overlapped signatures exiting from the end of the press are stream transferred horizontally on conveyor 2, crushed at crusher station 10, to exhaust air and compact them, and jogged at jogger station 14 to align them prior to entry into stacker 100.

Stacker 100 has an input end 16, sets of opposing, floating, compressive, conveyor timing belts 18 and 20, an upwardly arcing set of rollers 22 and a receiver station 24 at output end 26. Upon introduction into the input end 16, the signatures enter a compression zone at the nip of the two conveyors 18 and 20 which maintain the signatures fully compressed and aligned during their transition from a horizontal to a vertical position. The timing belts travel a continuous path, part of which is adjacent to the upwardly sloped roller arc 22. The arc path is approximately ninety degrees. The conveyor 20, while not directly contiguous to rollers 22 indirectly applies compression against the conveyor 18 and the rollers 22 via the signatures which are conveyed between floating conveyors 18 and 20. This system creates a suitable compression zone for the controlled passage of the overlapped signatures through transition from horizontal to vertical prior to actual stacking. After leaving the compression zone, the stream of signatures is provided with an upward thrust along arcuate set of rollers 22 and is stopped and brought into a vertical stacking mode at receiver station 26 where it is formed into a stack which has the shape of an ever enlarging rectangular stack. As the signatures continue into and out of the stacker conveyors they are received and stacked vertically as shown at 28 on exit table 30 which is described more fully hereinafter. The stacks are then moved by a bundle transfer apparatus to a downstream position for further processing. As shown in FIG. 2, stacker 100 comprises an outer framework which supports and connects the other operating parts of the device. An upper conveyor system comprises upper conveyor belts 18, idler pulley take up assemblies 34, upswept arcuate idler rollers 22, adjustment pulleys on a shaft 49 and drive shaft pulley assembly 42. On the far side of the stacker, each of the rollers 22 are rotatably mounted within the outer framework. However, on the near side of the stacker, each of the rollers 22 is preferably rotatably mounted within an inner framework 44. Hole 45 is provided for the mounting of a shaft which allows the pivoting of take up pulley assemblies 34 on the shaft. The lower conveyor system comprises conveyor belts 20, drive shaft pulley assemblies including pulleys 52 and take up pulley assemblies 54. Both upper and lower conveyor systems 18 and 20 preferably comprise five endless timing belts, laterally spaced a few inches apart from one another. They may be tensioned by means of pulleys as desired. The diameter of each conveyor roller may be made suitable to design by the skilled artisan.

The leading edge of each signature passes by and is guided by roller 72 and then roller 74 as shown in FIG. 2. The leading edge of each signature then strikes stripper fingers 76 and simultaneously the trailing edge is kicked by kicker 75 thus maintaining space for subsequent signature leading edges. Each signature is displaced sideways from the stripper fingers 76 by a following signature. Then the signatures have essentially completed the transition from a horizontal position to a vertical position. The signature is subsequently engaged by delivery table conveyor belts 104 as shown in FIG. 3 while in a vertically aligned position.

Figure 3:
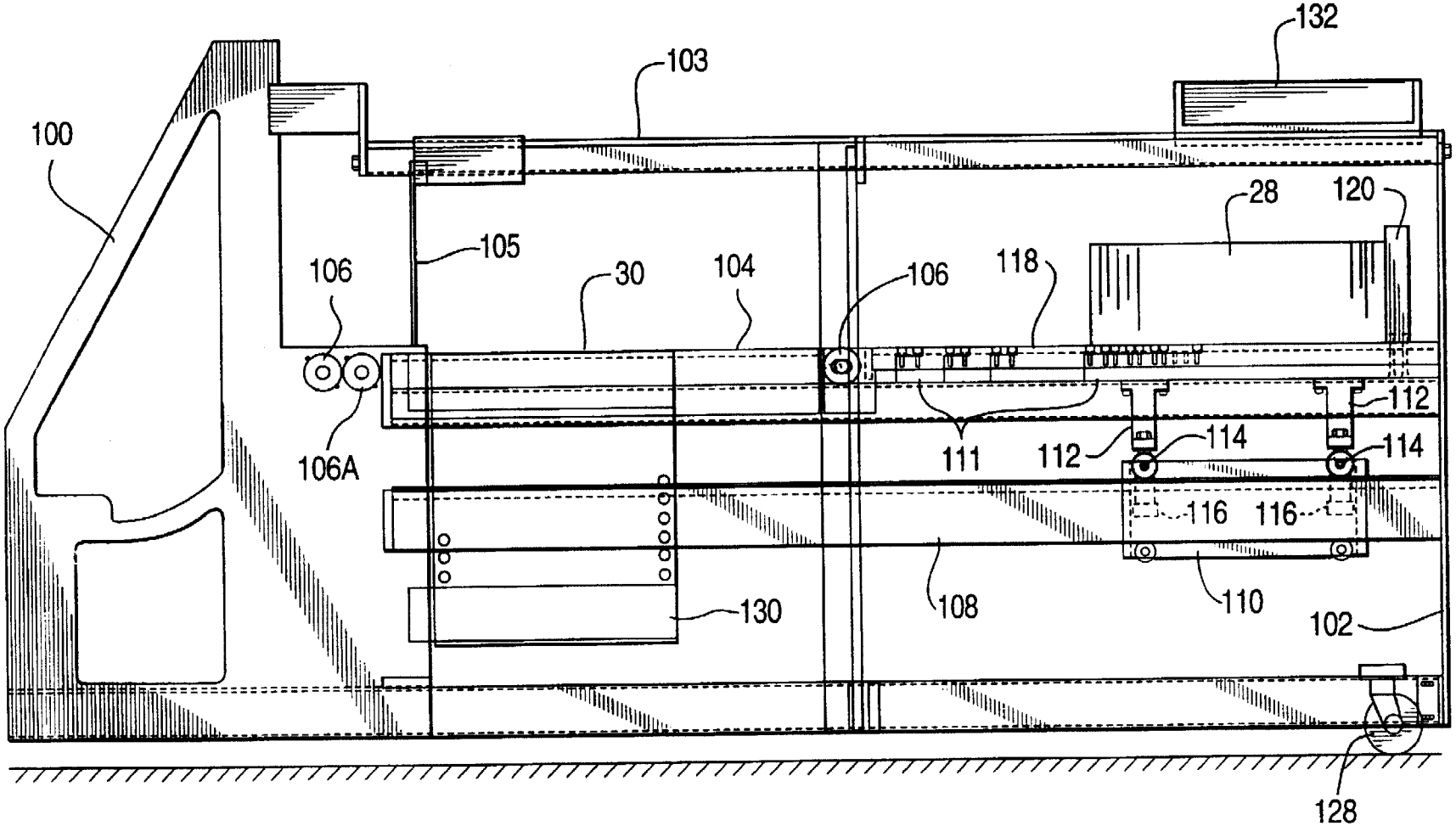
FIG. 3 shows a side sectional view of a overall bundle transfer apparatus which cooperates with a stacker.
Figure 4:
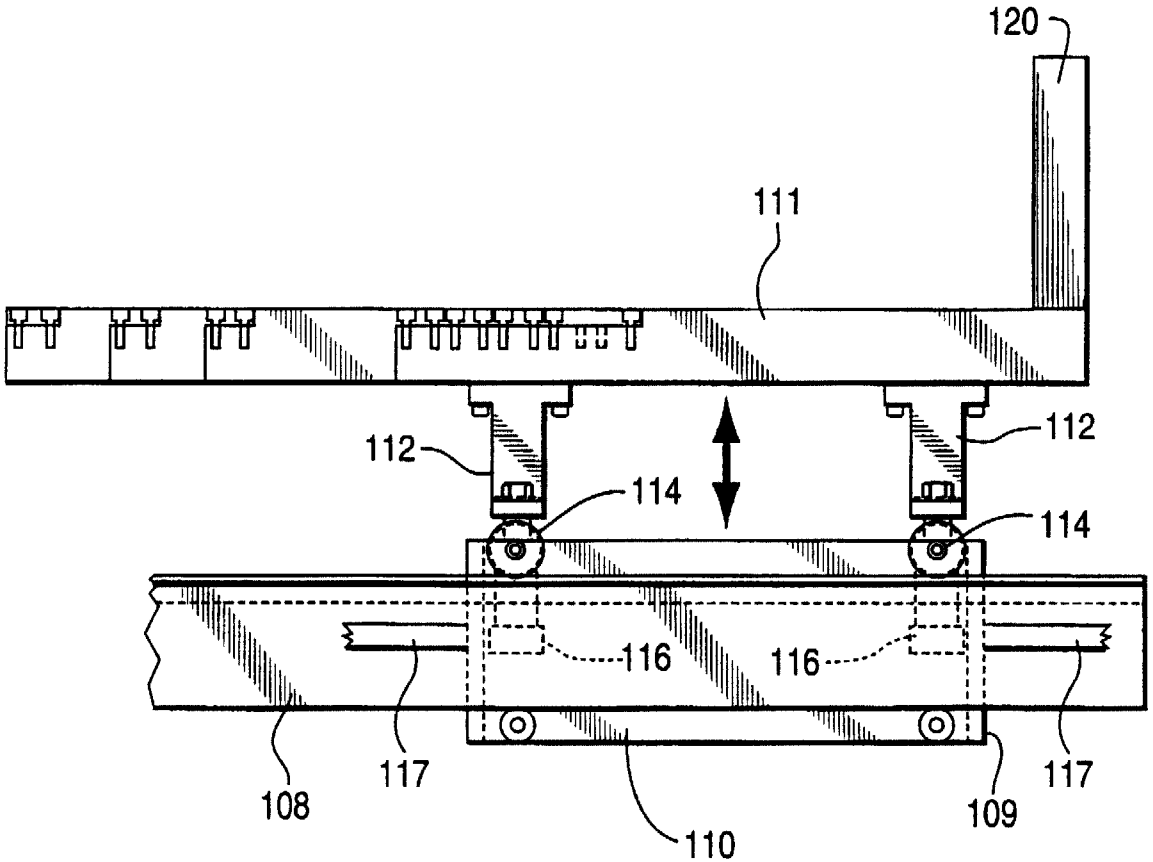
FIG. 4 shows an enlarged side sectional view of a bundle transfer vehicle part of the bundle transfer apparatus.
Figure 6:
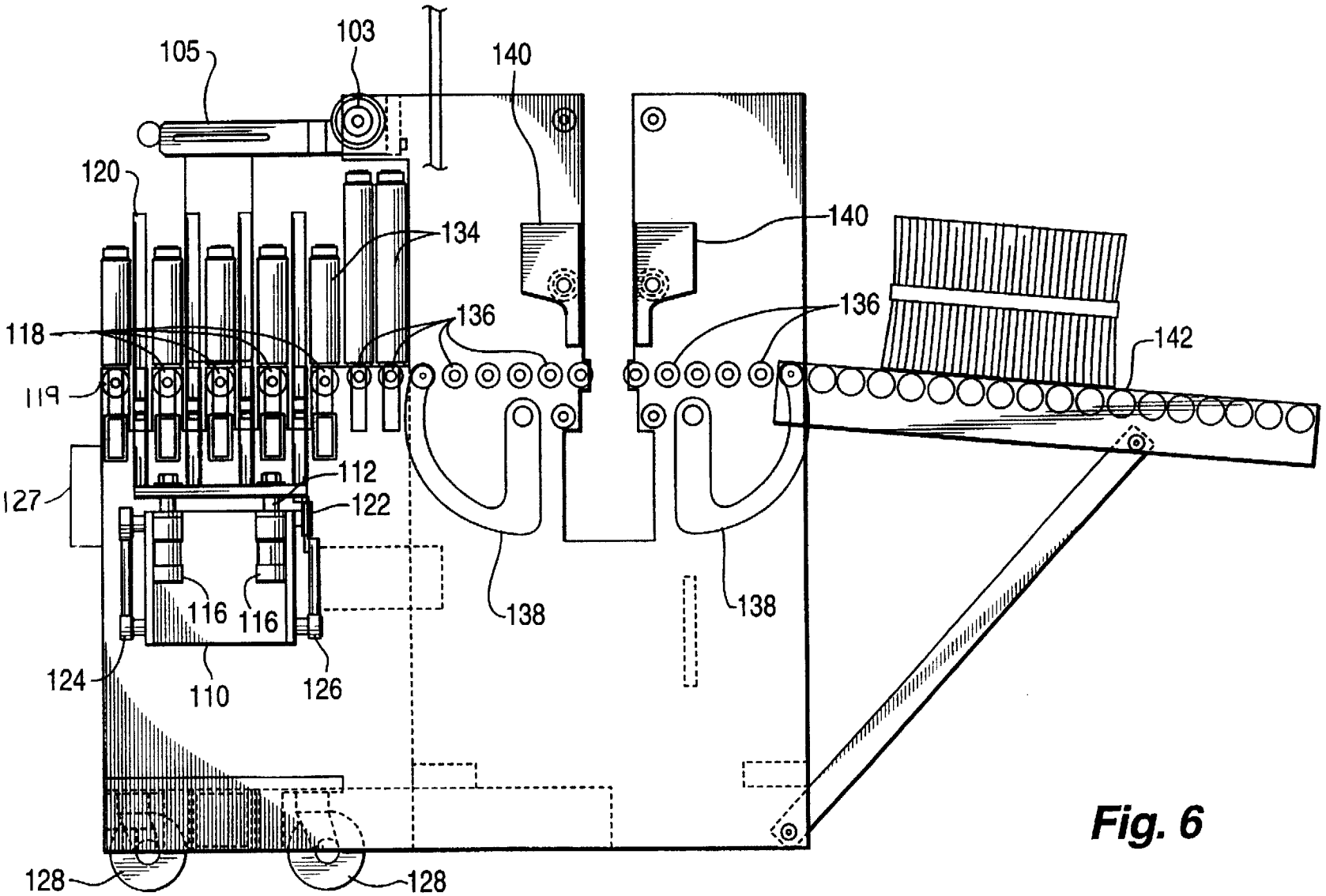
FIG. 6 shows an end view of a preferred embodiment of a bundle transfer apparatus including a powered bundling station.

FIGS. 3 and 4 show a side sectional view of the preferred apparatus of this invention which cooperates with the stacker. The apparatus moves an assembled collection of substantially on-edge, vertically aligned signatures away from exit table 30 for subsequent compression and strapping of the signatures for shipment or storage. The apparatus comprises a frame 102 which is attached to stacker 100 by suitable means. On the level of exit table 30 is a conveyor mounted longitudinally in the frame at its rearward section and which extends a part of the distance along the length of the frame. The conveyor comprises a series of horizontal conveyor belts 104 which are spaced apart to form gaps between them. The conveyor belts, driven by idler pulleys 106 and powered pulleys 106A convey the product away from exit table 30. The conveyors receive the sheet material in the form of an ever growing stack of vertically aligned signatures that grows horizontally in the direction of the belts. Along the top of the frame 102 is a structural assembly or rail 103 along which rides a rigid, pivotable bar or product support assembly 105 which is best seen in FIG. 6. The product support assembly provides a slight stabilizing force for the leading end of the growing stack of signatures and maintains the signatures in a vertical position. The product support provides a force on the stack in the opposite direction of the movement of the stack and moves with the leading face of the stack as it grows. Also on the frame 102 are rigidly mounted stationary rails 108 mounted essentially horizontally in the frame, which extend parallel to and at a level lower than the top of the conveyor belts 104. The rails extend from the rearward section of the frame where the rails underlie the conveyor to a forward section of the frame. The apparatus also comprises a two part bundle transfer vehicle assembly 110. A first part of the bundle transfer vehicle comprises a rolling element portion 109. The rolling element portion comprises a framework having friction reducing means 114 which are preferably wheels. Other useful friction reducing means include Thompson rod type bearings or other rolling means. Such means reduce resistance to motion in a direction parallel to the rails. In the most preferred embodiment the friction reducing means are wheels which ride on rails 108. The second part of the bundle transfer vehicle is a raisable part which raises and lower the signatures. It comprises a series of upright support segments 112 which preferably comprise a series of upwardly projecting elements on the top of which are situated a series of horizontal support members 111 which are interdigitated and align with the gaps between the conveyor belts. The elevator part also includes means 116 for raising and lowering the support segments relative to the rolling element portion. These are mounted on the rolling element portion and attach to the support segments. In the preferred embodiment these raising and lowering means are air cylinders, but the invention is not limited thereto. In use, the support segments 112 are lowered to a first position by the air cylinders and placed by the rolling element portion at the rear of frame 102 below the conveyor belts. The support segments are then raised by the air cylinders to a second position above the conveyor belts. Thus when at the second position, the support segments lift and hold the stacked sheet material in signature form above the conveyor belts. The arrow indicates the up and down motion of the support segments. The bundle transfer vehicle assembly 110 then moves the support segments and signatures in a direction along the rails until they are at a forward location in the frame 102. The air cylinders then retract and lower the support segments, depositing the signatures on a table or rollers 118 at the forward location on the frame as shown in FIG. 3. Table 118 comprises a series of horizontally disposed parallel rollers which are aligned with the ends of conveyors belts 104. These allow the passage of the support segments between them since they are also interdigitated and aligned with the gaps between the rollers. These rollers are more fully described hereinafter. Also shown in FIG. 4 are drive means 117 which may provide for the powered movement of bundle transfer vehicle assembly 110 along rails 108. Any means which can direct the powered motion of the bundle transfer vehicle 110 back and forth along rails 108 can be used. Such include a driven timing belt and a clamping device which causes the bundle transfer vehicle to grip the belt, a screw drive, air cylinders or a motor mounted on the bundle transfer vehicle which engages rails 108. Such may include means to connect or disconnect the power transmission by means of a clutch or other similar device such that when the clutch is engaged, the bundle transfer vehicle may be driven and when the clutch is disengaged, the bundle transfer vehicle is free to move along the rails such as by the application of hand pressure. Various bundle transfer vehicle powering arrangements are shown in FIGS. 7–10.

Figure 5:
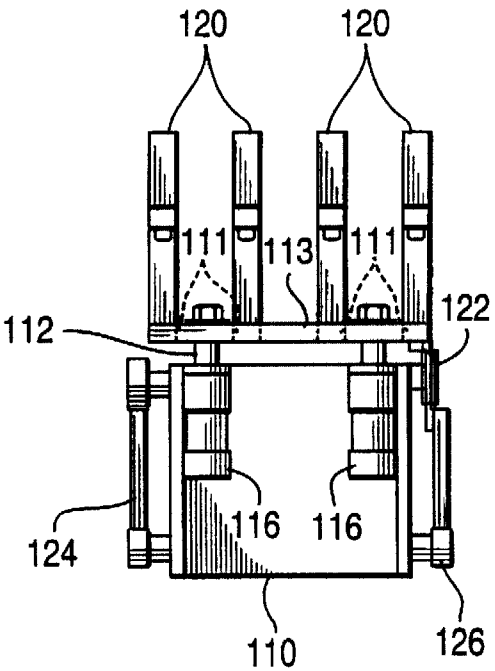
FIG. 5 shows an end view of the bundle transfer vehicle.

FIG. 5 shows an end view of the bundle transfer vehicle of the inventive apparatus. Shown are backstop 120, the ends of horizontal support members 111, a backplate 113 for the horizontal support members, and air cylinders 116. Also shown is a guide means preferably comprising v-roller 122 and cam followers 124 and 126 which stabilizes the bundle transfer vehicle and keeps it aligned along the rails 108 and which provide rolling inertia. Backstop 120 is attached at an end of the bundle transfer vehicle as shown and extends above the level of table 118 as shown in FIG. 3. When the bundle transfer vehicle is at its rearmost position and the signatures are moved forward by the conveyor belts 104, product support 105 supports the stack of signatures until it reaches backstop 120. Backstop 120 then assumes support for the growing stack of vertical signatures while the product support is recycled to the rearmost portion of the machine. The backstop continues to support the signatures while they are moved from the rearward to the forward positions of frame 102 by the bundle transfer vehicle.

FIG. 6 shows an end view of a preferred embodiment of the bundle transfer apparatus including a powered bundling and strapping station. After the stack of signatures is transferred onto powered roller table 118, it is moved by powered horizontal rollers 136 and guided by vertical rollers 134 to a bundling station where it is aligned in place by pivoting clamps 138, compressed by air cylinder rams 140 and strapped with suitable automatic strapping machines. Optionally rollers 134 may also be powered. The strapping is preferably applied by a fully automatic strapping head such as is commercially available from Dynaric or Signode and are well known to those skilled in the art. The compressed and strapped stack then leaves by means of the powered rollers 136 onto exit conveyor 142. The entire bundle transfer apparatus may be mounted on caster wheels 128 so that it may be moved into and out of cooperation with an upstream folder, cutter and/or press. The operation of the bundle transfer apparatus is controlled by a suitable programmable logic controller which is located in a control box 130 which may further contain a transformer and motor starter, all of which are well known in the art. These provide the power and controls to direct the back and forth motion of the bundle transfer vehicle, the raising and lowering motion of the raising and lowering means on the bundle transfer vehicle, the conveyor belts, the product support, the powered rollers, powered clamps, air cylinder rams and strapping head and all other elements of the apparatus. FIG. 3 shows a switchbox 132 containing suitable controls and switches for the control box.

Figure 7:
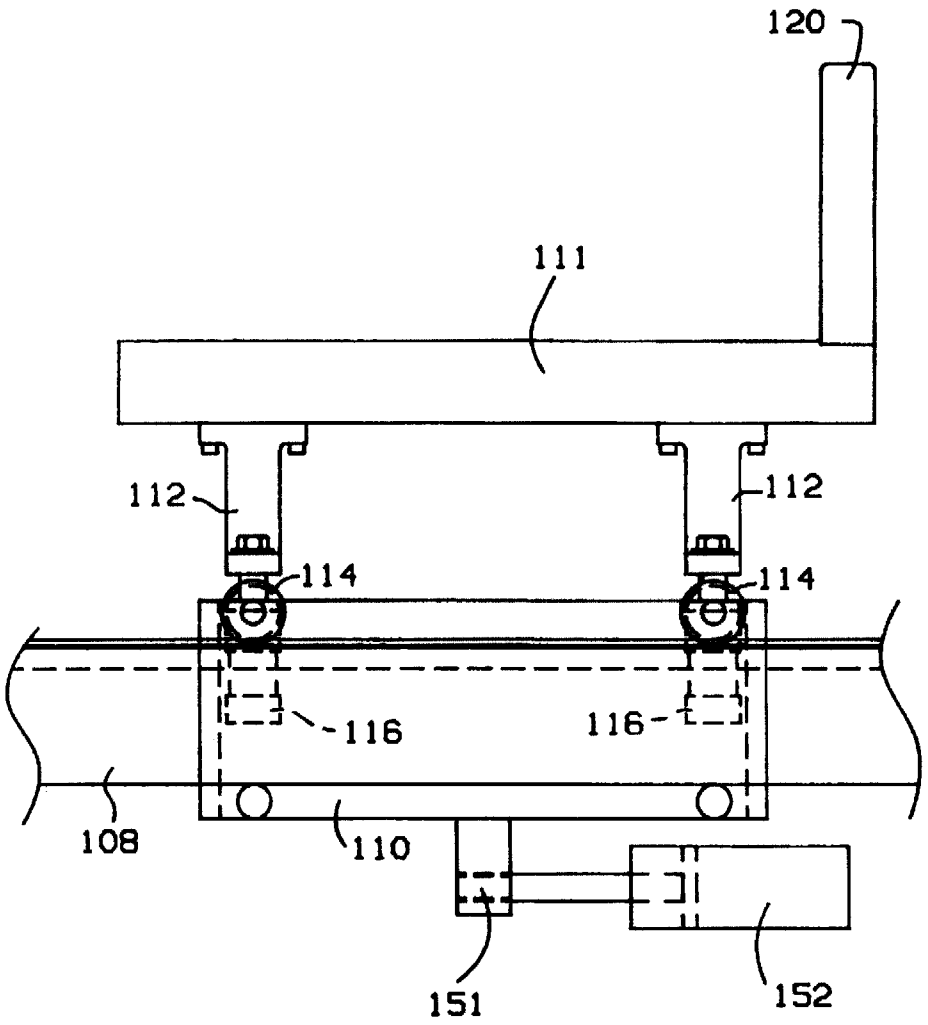
FIG. 7 shows an air cylinder arrangement for powering the bundle transfer vehicle.

FIG. 7 shows one arrangement for powering the motion of the bundle transfer vehicle along the rails. Air cylinder 152 provides power to move the bundle transfer vehicle 110 through a connection device 151. Connection device 151 may include a clutch device to connect and disconnect the air cylinder from the bundle transfer vehicle such that when the clutch is engaged the bundle transfer vehicle may be driven in either direction by the air cylinder. When the clutch is disengaged, the bundle transfer vehicle is free to move along the rails by the application of hand pressure by an operator.

Figure 8:
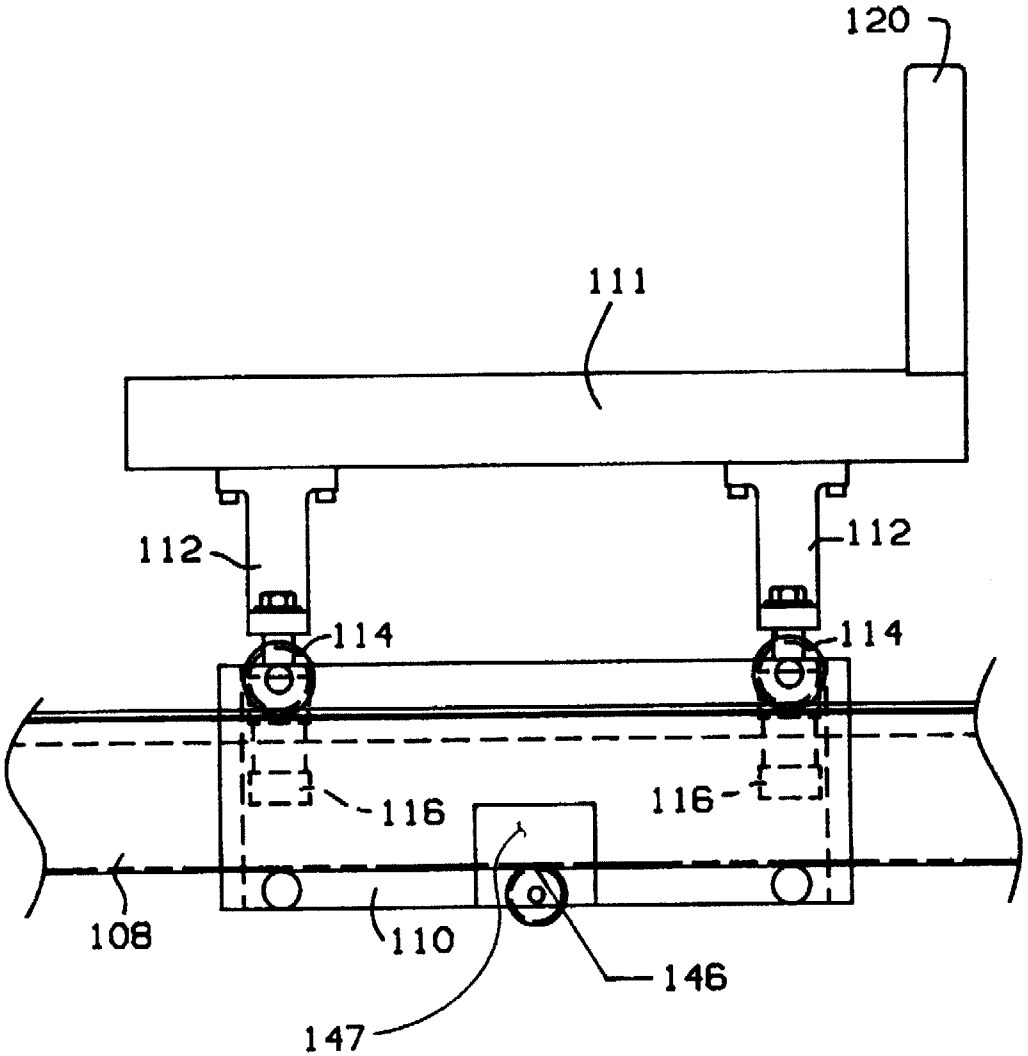
FIG. 8 shows a motor and gearbox assembly for powering the bundle transfer vehicle.

FIG. 8 shows a motor and gearbox assembly 147 mounted on the lower portion of bundle transfer vehicle 110. It drives output shaft and driver assembly 146 which cooperates with rail 108. This may be a rack and pinion type arrangement or it may be a wheel and surface drive based on friction. Shaft and driver assembly 146 may include a clutch device that is actuated such that when the clutch is engaged the bundle transfer vehicle may be driven in either direction and when the clutch is disengaged, the bundle transfer vehicle is free to move along the rails by the application of hand pressure by an operator.

Figure 9:
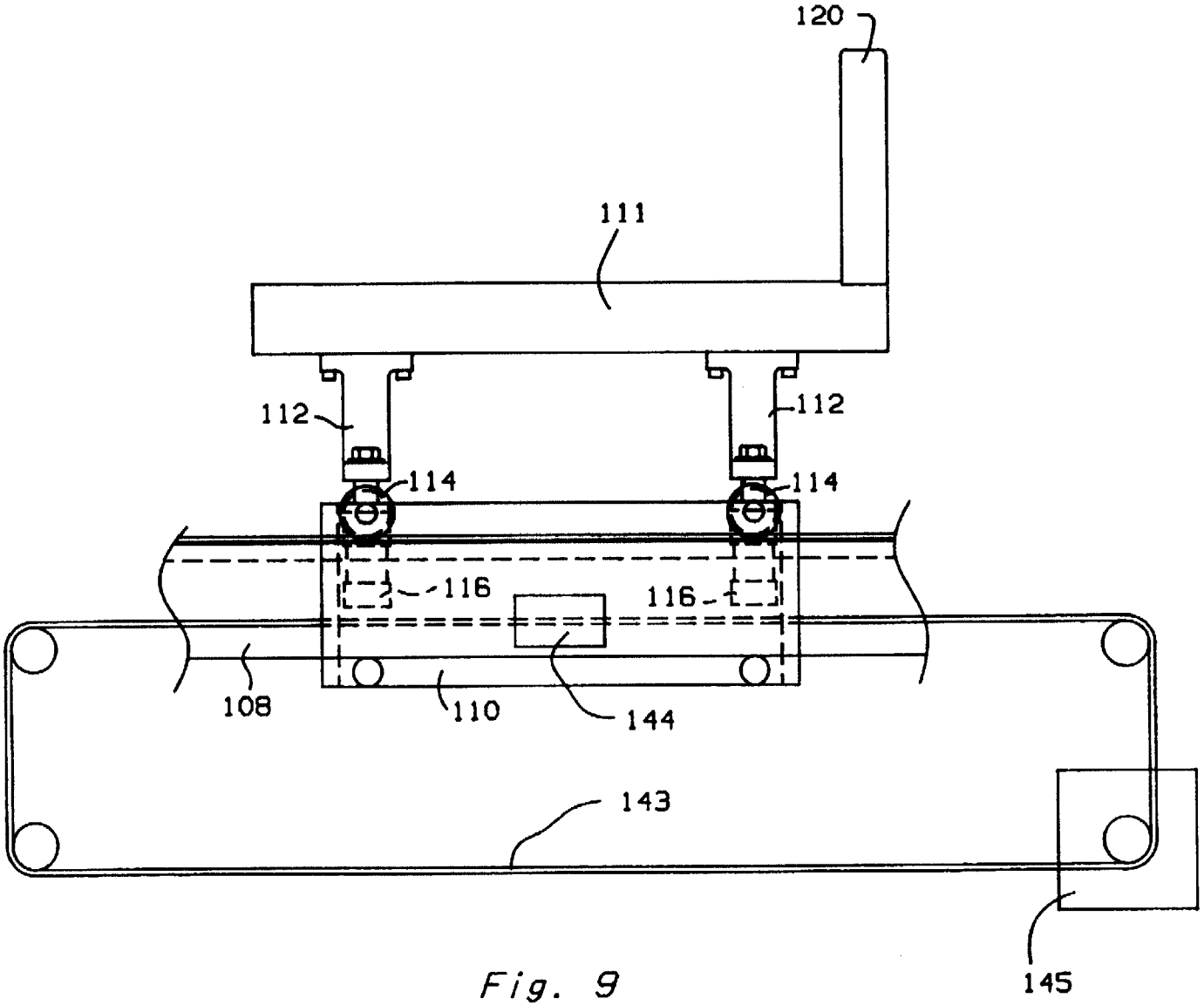
FIG. 9 shows a drive belt driven by a motor and gearbox assembly for powering the bundle transfer vehicle.

FIG. 9 shows a drive belt 143 such as a timing belt driven by motor/gearbox assembly 145. Clamping device assembly 144 can engage or disengage, that is clamp or unclamp from the timing belt such that when the clamp is engaged, the bundle transfer vehicle may be driven in either direction and when the clamp is disengaged, the bundle transfer vehicle is free to move along the rails by the application of hand pressure by an operator.

Figure 10:
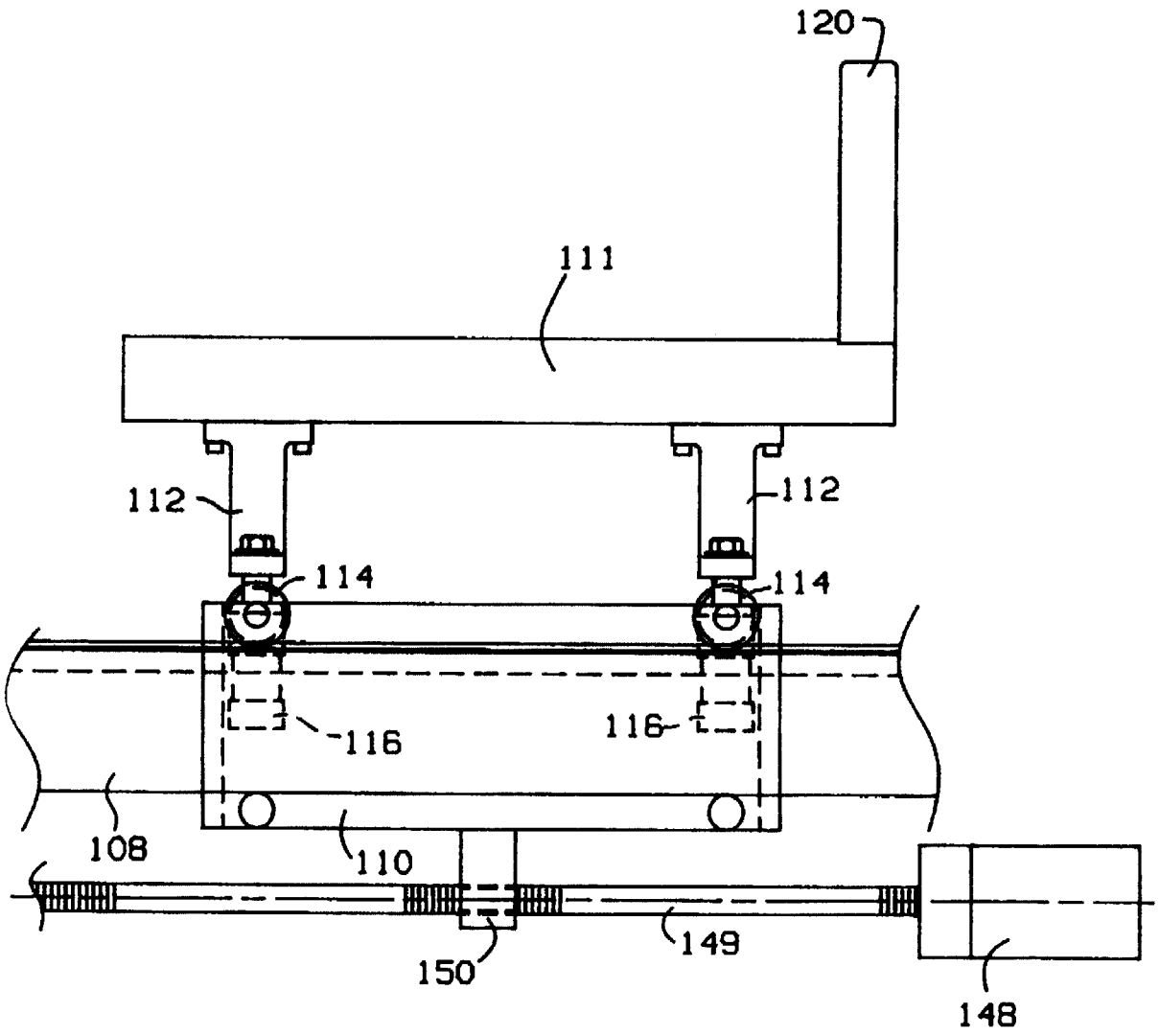
FIG. 10 shows a motor, gearbox and clutch assembly which drives a screw for powering the bundle transfer vehicle.

FIG. 10 shows a motor/gearbox/clutch assembly 148 which drives a screw or ball screw 149. The engageable/disengageable nut assembly 150 cooperates with screw 149 and is connected to the bundle transfer vehicle 110. When the nut is engaged, the bundle transfer vehicle may be driven in either direction and when the nut is disengaged, the bundle transfer vehicle is free to move along the rails by the application of hand pressure by an operator. The clutch in the motor/gearbox/clutch assembly 148 may also be used to control the powered transferred to the bundle transfer vehicle 110.

Figure 11:
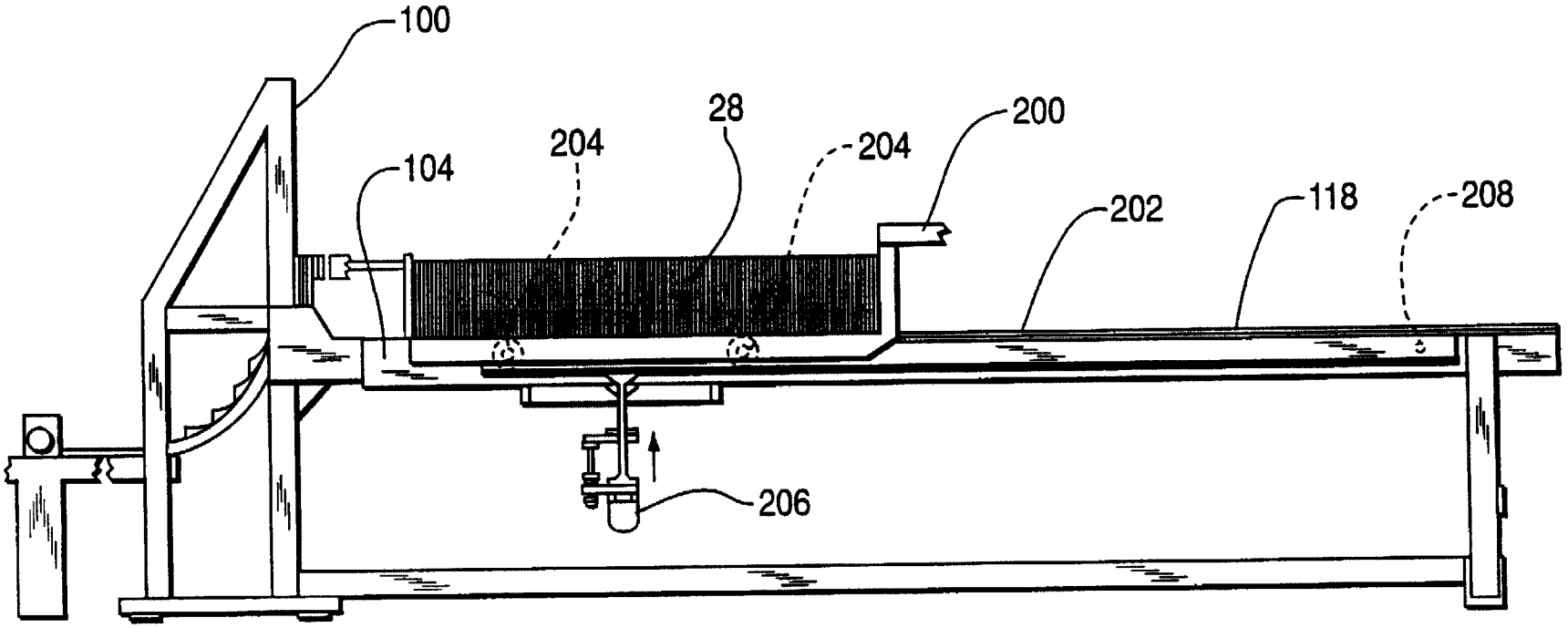
FIG. 11 shows another version of the invention wherein the bundle transfer apparatus rides on a liftable rail.

FIG. 11 shows another embodiment of the invention wherein a bundle transfer apparatus rides on a liftable rail. In this version, a stacker 100 forms a growing stack of signatures 28 on an exit conveyor 104. A one piece bundle transfer apparatus 200 rides left to right and vice versa on rails 202 via wheels 204. As shown in FIG. 11, bundle transfer vehicle 200 underlies the stack 28. Lift cylinder 206 then raises the rails 202 together with bundle transfer vehicle 200 and stack 28 above the level of conveyor 104 and the bundle transfer vehicle 200 and stack 28 are moved to the right depositing the stack onto powered roller table 118. In another embodiment, lift cylinder 206 pivots rails 202 around fulcrum point represented by 208.

Figure 12:
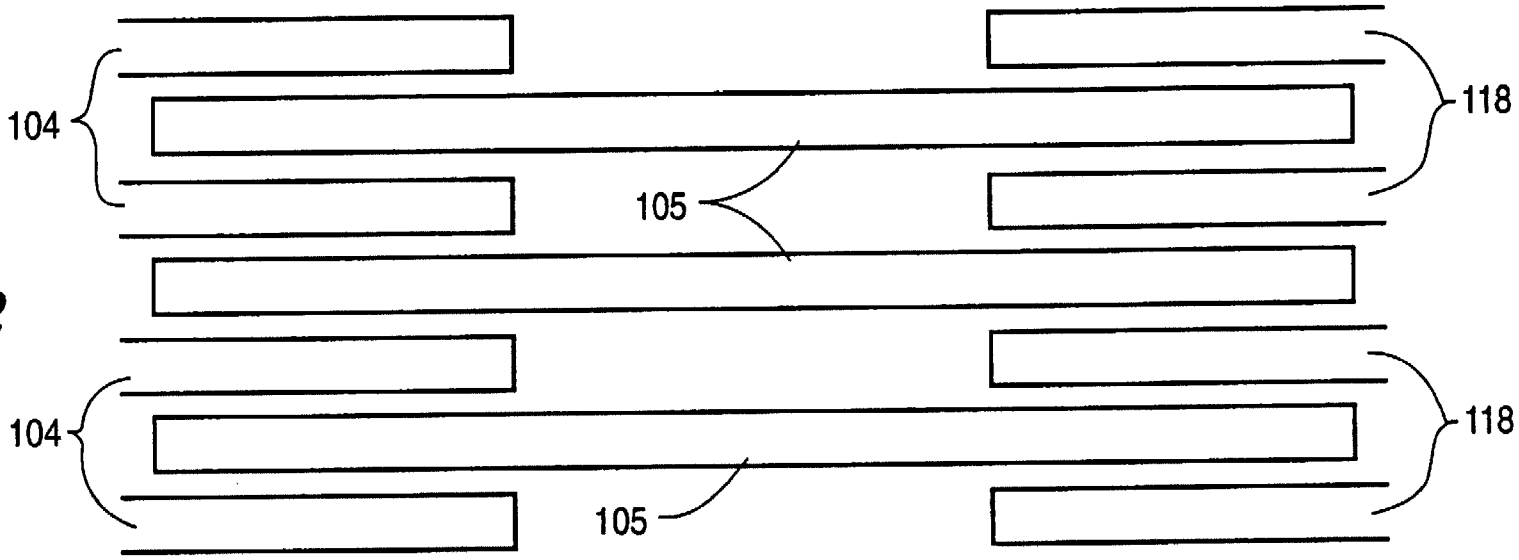
FIG. 12 shows a top view of another version of the invention wherein a bundle is deposited onto a powered roller table by interdigitated conveyors.

FIG. 12 shows a top view of another version of the invention wherein a stack is transferred onto a powered roller table by interdigitated conveyors. In this embodiment, a stacker forms a growing stack of signatures on an exit conveyor 104. Interdigitated with exit conveyor 104 is transfer conveyor 105 comprising a series of conveyor belts. As a stack is formed on exit conveyor 104, transfer conveyor 105 is not in motion and is positioned at a level below that of exit conveyor 104. When a stack of desired size is formed, transfer conveyor 105 lifts above the level of exit conveyor 104 and then moves to the right in the direction of the arrow thus moving the stack to the right during which time transfer conveyor 105 is also above the level of powered roller table 118. When the stack is properly positioned over powered roller table 118, transfer conveyor 105 stops and drops down below the level of powered roller table 118 thereby depositing the stack onto powered roller table 118.

Figure 13:
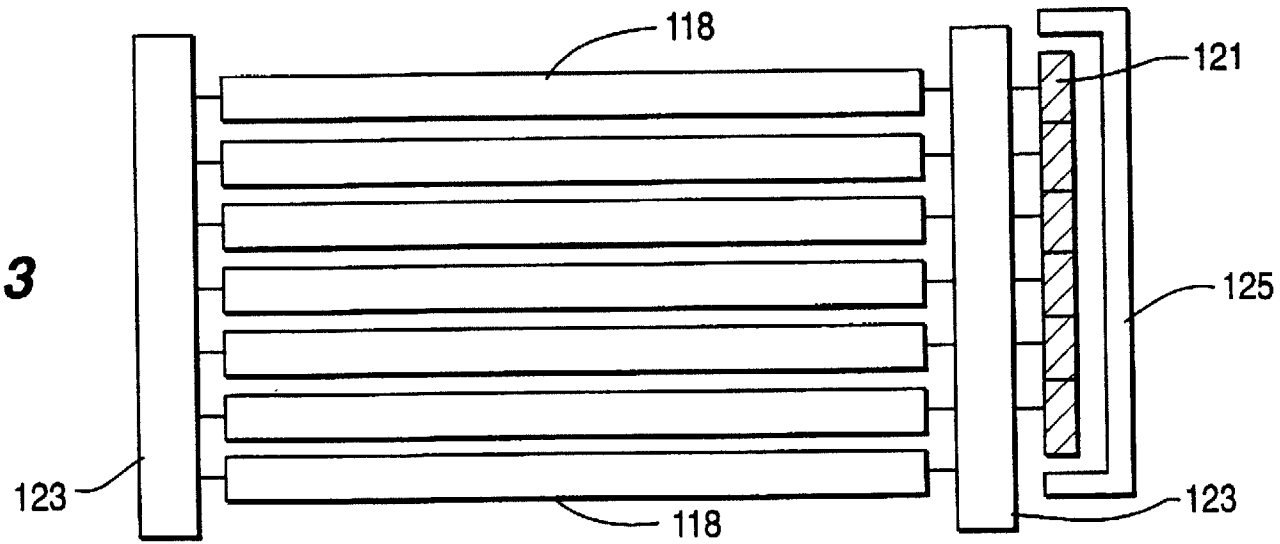
FIG. 13 shows a top view of a powered roller table useful for the invention.

FIG. 13 shows a top view of a powered roller table useful for the invention. It is shows to comprises an array of rollers 118 which are driven by suitable means such as gears or sprocket means 121 which preferably cooperate with drive chains and a motor, not shown. In the preferred embodiment, the first roller 119 is an idler roller. This idler roller is preferred for safe operation since it is closest to the position of a operator. As shown, each roller has a diameter of about two inches and they are spaced about one-half inch apart. Each has a central shaft mounted by appropriate frames 123. Also, for safe operation, all powered rollers turn in the same direction, e.g. clockwise to avoid creating pinch points. Preferably the chain and sprocket drives are shielded by a guard 125. The powered roller table is provided with suitable switching means which may be either manually or automatically actuated. In one embodiment, the driven rollers may be actuated by an automatic switch responsive to the position of the bundle transfer vehicle or conveyor after depositing the sheet material on the rollers. In another embodiment, the driven rollers may be actuated by a manually operated switch responsive. In the most preferred embodiment, a manually operated switch is a flat plate button bar, spring recovery switch which is mounted on the side of the apparatus. This is shown as part 127 in FIG. 6. Such an arrangement accommodates different operator sizes, left and right hand dominant people, and avoids loose floor positioned switches. In operation, an operator need only lightly touch the switch with a hand or knee in order to actuate the powered rollers.

While the invention has been shown and described with reference to a preferred embodiment, it is not to be considered limited thereby, but only construed in accordance with the following claims.

What is claimed is:

1. An apparatus for transferring a bundle of sheet material in signature form comprising:

(a) a horizontal frame;

(b) a conveyor mounted longitudinally in the frame at an upper portion of a rearward section thereof and extending a part of the distance along the length of the frame, the conveyor comprising a plurality of horizontally disposed conveyor belts which are spaced apart to form gaps therebetween and which receive the sheet material in the form of a bundle of signatures on top of the belts;

(c) one or more rails mounted on the frame and extending about parallel to the conveyor belts from the rearward section of the frame to a forward section of the frame;

(d) a bundle transfer vehicle on the rails, said vehicle comprising a framework and friction reducing means mounted on the framework, which friction reducing means engages and rides on the rails; the framework having support segments thereon which are interdigitated and substantially aligned with the gaps between the conveyor belts, the support segments being capable of lifting and holding the sheet material away from the conveyor and depositing it onto a table; said table being located on the horizontal frame forward of the rails; said table comprising a plurality of parallel, horizontally disposed driven rollers which are spaced apart to form gaps therebetween and which is capable of receiving the sheet material on top of the table, said rollers being aligned with one of said conveyor belts and allow the passage of the support segments interdigitated in the gaps between the rollers.

2. The apparatus of claim 1 wherein the rollers turn in the same direction.

3. The apparatus of claim 1 wherein the table roller immediately adjacent to the horizontal frame is an idler roller.

4. The apparatus of claim 1 wherein the driven rollers are actuated responsive to a switch.

5. The apparatus of claim 1 wherein the driven rollers are actuated by a manually controlled switch.

6. The apparatus of claim 1 wherein the driven rollers are actuated by a manually controlled switch positioned on the horizontal frame.

7. The apparatus of claim 1 wherein the driven rollers are actuated by an automatic switch responsive to the position of the bundle transfer vehicle after depositing the sheet material on the rollers.

8. The apparatus of claim 1 wherein each driven roller is connected to the next adjacent driven roller by sprocket means.

9. The apparatus of claim 1 wherein each driven roller is connected to the next adjacent driven roller by chain and sprocket means.

10. The apparatus of claim 1 further comprising means for biasing the bundle transfer vehicle for movement in at least one direction along the rails.

11. The apparatus of claim 1 wherein the friction reducing means comprises a plurality of wheels.

12. The apparatus of claim 1 further comprising a stacker attached to the horizontal frame adjacent to the conveyor.

13. The apparatus of claim 1 further comprising means to drive the bundle transfer vehicle along the rails.

14. The apparatus of claim 13 wherein the means to drive the bundle transfer vehicle along the stationary rails is selected from the group consisting of a combination of a driven timing belt and means for clamping the bundle transfer vehicle to the belt, an air cylinder, a screw drive, and a motor mounted on the bundle transfer vehicle which engages the rails.

15. The apparatus of claim 13 further comprising clutch means for selectively engaging and disengaging the means to drive the bundle transfer vehicle along the rails.

16. An apparatus for transferring a bundle of sheet material in signature form comprising:

(a) a horizontal frame;

(b) a conveyor mounted longitudinally in the frame at an upper portion of a rearward section thereof and extending a part of the distance along the length of the frame, the conveyor comprising a plurality of horizontally disposed conveyor belts which are spaced apart to form gaps therebetween and which receive the sheet material in the form of a bundle of signatures on top of the belts;

(c) one or more rails on the frame and extending about parallel to the conveyor belts at least a part of the distance from the rearward section of the frame to a forward section of the frame, and means for raising and lowering the rails with respect to the conveyor;

(d) a bundle transfer vehicle on the rails, said vehicle comprising a framework and friction reducing means mounted on the framework, which friction reducing means engages and rides on the rails; the framework having support segments thereon which are interdigitated and substantially aligned with the gaps between the conveyor belts, the support segments being capable of lifting and holding the sheet material away from the conveyor and depositing it onto a table; said table being located on the horizontal frame forward of the rails; said table comprising a plurality of parallel, horizontally disposed driven rollers which are spaced apart to form gaps therebetween and which is capable of receiving the sheet material on top of the table, said rollers being aligned with one of said conveyor belts and allow the passage of the support segments interdigitated in the gaps between the rollers.

17. The apparatus of claim 16 wherein said rails have forward ends which are pivotally mounted on the frame, and the means for raising and lowering the rails comprises means cooperating with a rearward end of said rails for inclining and declining the rearward end of the rails with respect to the forward end of the rails.

18. An apparatus for transferring a bundle of sheet material in signature form comprising:

(a) a horizontal frame;

(b) a first conveyor mounted longitudinally in the frame at an upper portion of a rearward section thereof and extending a part of the distance along the length of the frame, the first conveyor comprising a first series of horizontally disposed conveyor belts which are spaced apart to form gaps therebetween and which receive the sheet material in the form of a bundle of signatures on top of the first series of conveyor belts; and (c) a second conveyor comprising a second series of conveyor belts mounted on the frame and extending about parallel in a coveying direction to the first series of conveyor belts at least a part of the distance from the rearward section of the frame to a forward section of the frame; said second series of conveyor belts being interdigitated and substantially aligned with the gaps between the first series of conveyor belts, the second conveyor comprising means for alternately raising and lowering the second series of conveyor belts above and below the first series of conveyor belts; the second conveyor being capable of lifting and holding the sheet material away from the first conveyor and depositing the sheet material onto a table; said table being located on the horizontal frame forward of the second conveyor; said table comprising a plurality of parallel, horizontally disposed driven rollers which are spaced apart to form gaps therebetween and which is capable of receiving the sheet material on top of the table, said rollers being aligned with the second series of conveyor belts and allow the passage of the second series of conveyor belts interdigitated in the gaps between the rollers.

* * * * *